US005288226A

United States Patent [19]

Khemarangsan

[11] Patent Number: 5,288,226

[45] Date of Patent: Feb. 22, 1994

[54] CIGARETTE LIGHTER

[75] Inventor: Decha Khemarangsan, Samutsakorn, Thailand

[73] Assignee: Thai Merry Co., Ltd., Samutsakorn, Thailand

[21] Appl. No.: 9,589

[22] Filed: Jan. 26, 1993

[30] Foreign Application Priority Data

Jan. 29, 1992 [JP] Japan ..... 4-2764[U]

[51] Int. Cl.[5] ..... F23D 11/36

[52] U.S. Cl. ..... 431/153; 431/277

[58] Field of Search ..... 431/153, 277, 144, 145, 431/273, 255; 222/384, 153

[56] References Cited

U.S. PATENT DOCUMENTS 5,002,482 3/1991 Fairbanks et al. ..... 431/277

5,074,781 12/1991 Fujita ..... 431/277

*Primary Examiner*—James C. Yeung

*Attorney, Agent, or Firm*—Burgess, Ryan & Wayne

[57] ABSTRACT

In a lighting operation, a lock member is moved from a second lock portion to a first lock portion against a biasing force of a spring, thus enabling a lighting operation of an operating member. When the operating member is moved in this state, a stable lighting operation is performed. In the lighting operation, the lock member is disengaged from the first lock portion upon movement of the operating member, is automatically moved toward the second lock portion to inhibit movement of the operating member upon reception of the rotary biasing force of the spring, is automatically moved to the second lock portion upon reception of an upward force of the spring, and is securely locked at the second lock portion. As described above, this invention provides a cigarette lighter which can prevent an unintentional lighting operation of the operating member and safety of which is thus improved.

5 Claims, 4 Drawing Sheets

CIGARETTE LIGHTER

BACKGROUND OF THE INVENTION

I. Field of the Invention

The present invention relates to a cigarette lighter including a safety mechanism for locking an operation of an operating member for performing a lighting operation while the lighter is not used.

II. Description of the Prior Art

A certain type of conventional cigarette lighter has a safety mechanism e.g., a lock lever and a lock button, for locking an operation of an operating member for performing a lighting operation so as to prevent an unintentional operation of this operating member. The safety mechanism is effectively used to prevent an unintentional operation of the operating member in, e.g., a pocket, which is caused by an external force while the cigarette lighter is carried, and an unintentional operation of the operating member which is caused when the cigarette lighter is taken out of a pocket and the operating member catches part of clothes, and to prevent an infant from accidentally performing a lighting operation to cause an accident.

In the above-described prior art, however, in order to allow the safety device to lock an operation of the operating member and to allow the cigarette lighter to perform a normal lighting operation, the safety mechanism must be moved between a position to lock an operation of the operating member and a position to allow an operation of the operating member.

Therefore, a user is required to perform a special operation, and he or she tends to forget to move the safety device to the operation locking position. Even if the safety mechanism is moved to the position to lock an operation of the operating member, it is sometimes unintentionally moved to the position to allow an operation of the operating member.

As described above, in a conventional cigarette lighter, a safety mechanism does not satisfactorily function as a safety mechanism.

DISCLOSURE OF THE INVENTION

It is a principal object of the present invention to provide a highly safe cigarette lighter which can reliably prevent an unintentional lighting operation of an operating member.

In order to achieve the above object, according to the present invention, a cigarette lighter including an operating member which is moved to perform a lighting operation and a lock member which can be moved to a position to inhibit movement of the operating member and to a position to allow movement thereof, comprises a first lock portion for locking the lock member at a position to allow movement of the operating member, a second lock portion for locking the lock member at a position to inhibit movement of the operating member, and a spring for applying a rotary biasing force to the lock member, which is disengaged from the lock portion upon movement of the operating member, to move the lock member toward the second lock portion, and applying an upward force to the lock member to move the lock member to a lock position between the first and second lock portions.

According to the above-described means, when the lock member is moved from the second to first lock portion against the biasing force of the spring and locked at the first lock portion, a lighting operation of the operating member can be performed. The operating member is moved in this state to perform a stable lighting operation. After the lighting operation, the lock member is disengaged from the first lock portion by the operating member and is automatically moved, by the rotary biasing force of the spring, to the position where the operating member can be held not to be moved. In addition, the lock member is designed to receive the upward force from the spring to be reliably locked at the second lock portion to lock the movement of the operating member.

The above and other objects, features, and advantages of the present invention will be apparent from the following detailed description of an embodiment in conjunction with the accompanying drawings.

BEST MODE OF CARRYING OUT OF THE INVENTION

Figure 1:
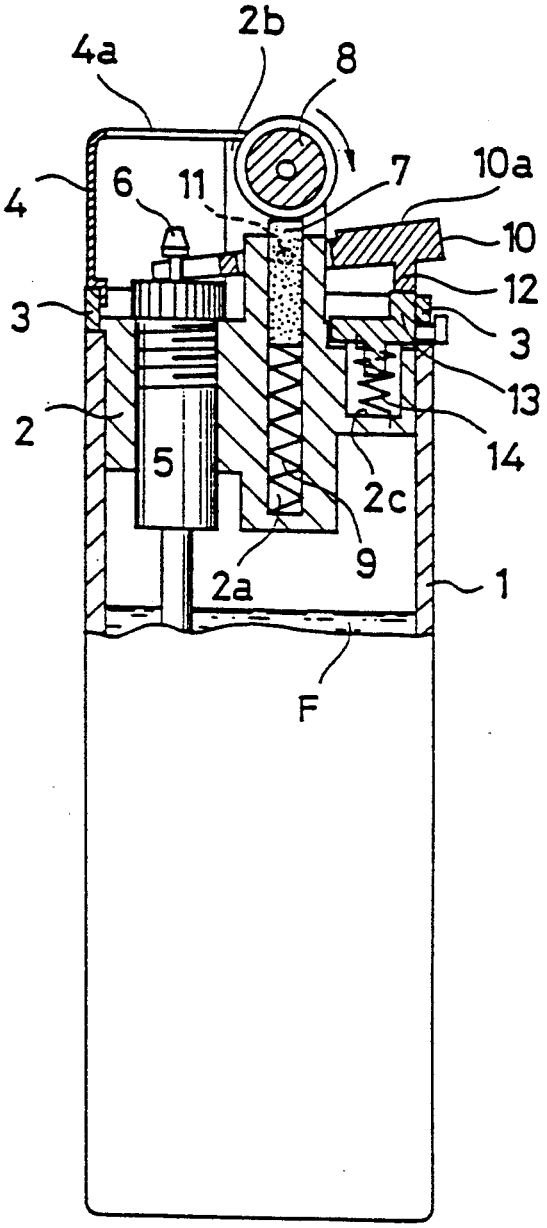
FIG. 1 is a sectional front view showing a cigarette lighter according to an embodiment of the present invention.

FIG. 1 is a partial sectional front view of a cigarette lighter according to an embodiment of the present invention. Referring to FIG. 1, reference numeral 1 denotes a fuel tank in which a fuel F is stored; 2, a lid member for closing an upper opening of the fuel tank 1; 3, an outer casing fixed to an upper peripheral portion of the lid member 2; 4, a windshield member fixed to an upper left portion of the outer casing 3 and having a lighting opening 4*a*; 5, a valve unit fixed to a left portion of the lid member 2; 6, a gas jet nozzle arranged on the valve unit 5 so as to be vertically movable; 7, a flint stored in a storage hole 2*a* formed in a central portion of the lid member 2; 8, a filing roller rotatably supported by a support wall 2*b* protruding from the lid member 2; 9, a press spring, stored in the storage hole 2*a*, for pressing the flint 7 against the filing roller 8; 10, a pivotable operating member having one end engaged with the gas jet nozzle 6 and the other end formed with a finger press portion 10*a* supported by a shaft 11 at a central portion; 12, a lock projection extending from a bottom portion of the operating member 10; 13, a lock member (to be described later) arranged on the lid member 2 below the lock projection 12; and 14, a return spring which is engaged with a bottom portion of a storage recess 2*c* of the lid member 2 and with a bottom surface of the lock member 13 so as to press the lock member 13 upward and to rotationally bias lock member 13 in one direction.

Figure 2:
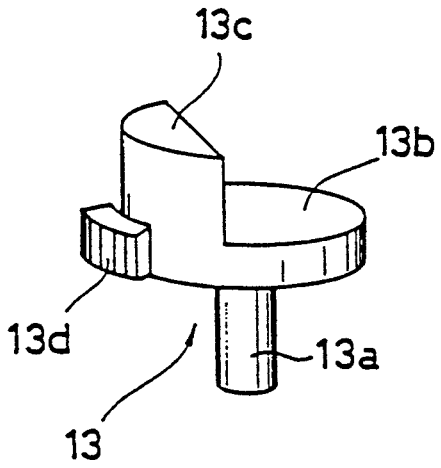
FIG. 2 is a perspective view of a lock member in FIG. 1.

FIG. 2 is a perspective view of the lock member in FIG. 1. The lock member 13 comprises a depending leg portion 13*a*, an upper flat portion 13*b*, an upper projection 13*c*, and an operating projection 13*d*.

Figure 3:
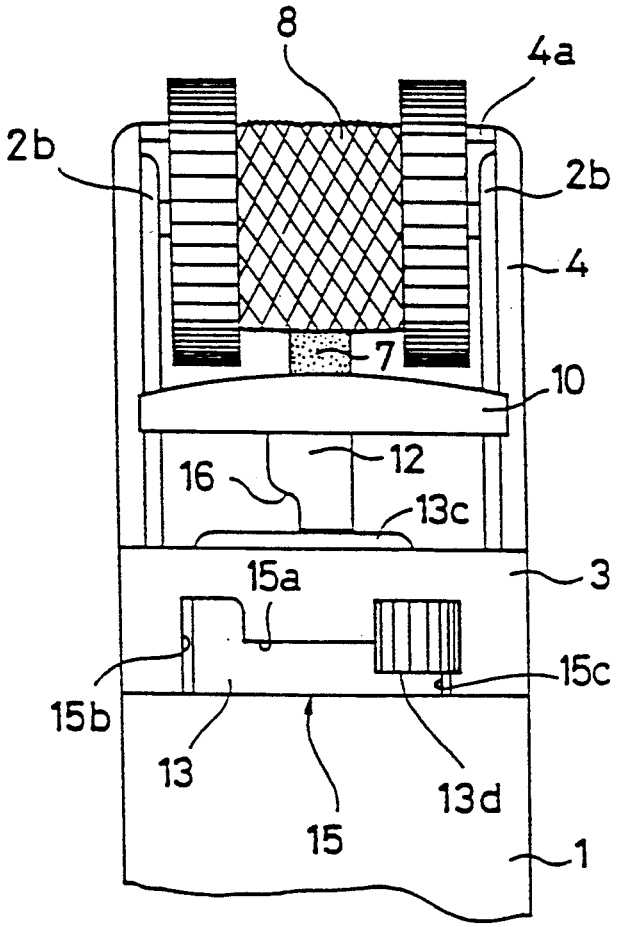
FIG. 3 is a right side view showing a main part of the embodiment in FIG. 1.

FIG. 3 is a right side view showing a main part of the embodiment shown in FIG. 1. The operating projection 13*d* of the lock member 13 protrudes from a substantially U-shaped guide hole 15 formed in a side portion of the outer casing 3 and constituted by a horizonal portion 15*a* and first and second lock portions 15*b* and 15*c* formed at two side portions of the horizontal portion 15*a* to extend upward. An inclined portion 16 is formed on a lower side portion of the lock projection 12 of the operating member 10.

An operation of the above embodiment will be described below.

A lighting operation is performed by the following known method. When the filing roller 8 is rotated clockwise in FIG. 1, sparks are generated by friction between the filing roller 8 and the flint 7. With rotation of the filing roller 8, the finger press portion 10*a* is pressed, and the left end of the operating member 10, which is rotated clockwise about the shaft 11, raises the gas jet nozzle 6 to jet the gasified fuel F. As a result, the jetted fuel is ignited by the sparks, and a flame is generated at the lighting opening 4*a* of the windshield member 4.

FIGS. 1 and 3 show a state wherein the operating member is locked. Referring to FIG. 3, the operating projection 13*d* of the lock member 13 is located and stopped at the second lock portion 15*c* of the guide hole 15 and is rotationally biased against a right end portion of the second lock portion 15*c* by the return spring 14 and held as it is urged against the upper portion of the second lock portion 15*c*. In this state, the upper projection 13*c* of the lock member 13 is in contact with a lower end of the lock projection 12 of the operating member 10, thus inhibiting the movement of the operating member 10.

Figure 4:
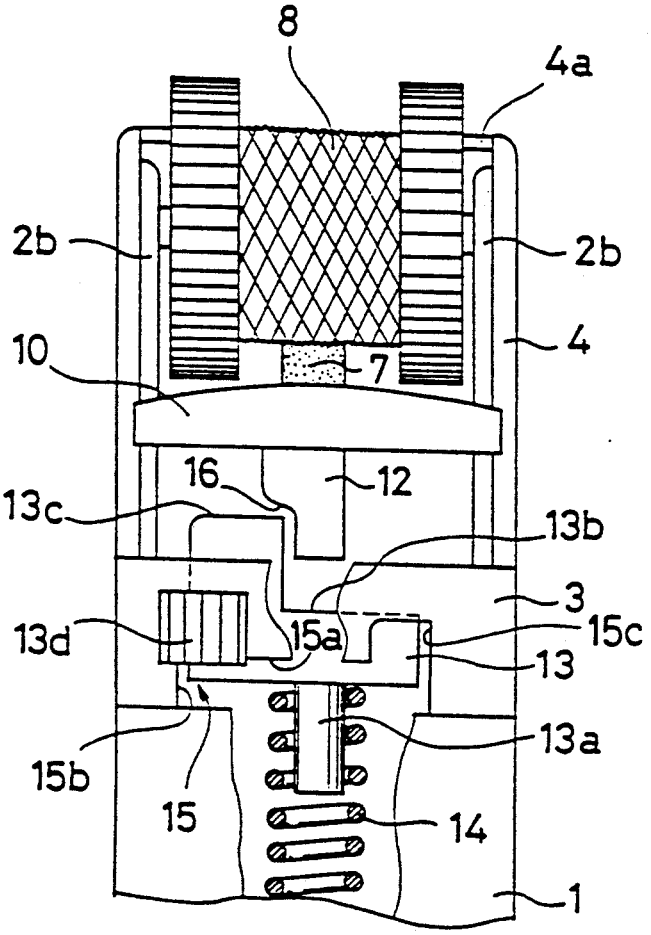
FIG. 4 is a partially cutaway right side view showing a lock release state in FIG. 3.

FIG. 4 is a partially cutaway right side view showing a state wherein the lock state of the operating member is released. When the operating projection 13*d* of the lock member 13 is moved downward from the second lock portion 15*c* to the horizontal portion 15*a* against the upward force of the return spring 14 and is further moved toward the first lock portion 15*b* against the rotary biasing force of the return spring 14, the operating projection 13*d* raises into the first lock portion 15*b* upon reception of the upward pressure of the return spring 14. Subsequently, the operating projection 13*d* is locked to an upper right portion of the first lock portion 15*b* upon reception of the upward pressure and rotary biasing force of the return spring 14. In this state, the upper flat portion 13*b* of the lock member 13 opposes a lower end of the lock projection 12 of the operating member 10, and the operating member 10 can be moved to allow the above-mentioned lighting operation.

When a lighting operation is performed, and the operating member 10 is lowered, the inclined portion 16 of the lock projection 12 of the operating member 10 pushes the upper projection 13*c* downward to move the lock member 13 downward as a whole. When the operating projection 13*d* of the lock member 13 is moved from the first lock portion 15*b* of the guide hole 15 to the horizontal portion 15*a*, the operating projection 13*d* is moved toward the second lock portion 15*c* at the right end portion of the horizontal portion 15*a* upon reception of the rotary biasing force of the return spring 14, and is locked at the upper right end portion of the second lock portion 15*c* upon reception of the upward pressure of the return spring 14. As a result, the operating projection 13*d* is held at a position to inhibit the movement of the operating member 10 again, as shown in FIG. 3.

As has been described above, according to the present invention, after a lighting operation, the operating member and the spring automatically move the lock member to the second lock portion where it can hold the operating member while inhibiting its movement. In addition, the lock member can be reliably held, by the spring, at the first lock portion at a position to allow the movement of the operating member and at the second lock portion at a position to inhibit such movement. Therefore, an unintentional lighting operation of the operating member can be reliably prevented while a stable lighting operation is ensured, and the safety of the cigarette lighter can be improved.

What is claimed is:

1. A cigarette lighter comprising:

an operating member movable to an actuating position to perform a lighting operation;

lock member means for permitting movement of said operating member means when said lock member means is in a first position and for preventing movement of said operating member means when said lock member means is in a second position;

first lock portion means for releasably locking said lock member means at said first position, wherein actuation of said operating member causes said lock member means to disengage from said first lock portion means;

second lock portion means for releasably locking said lock members at said second position in a non-rotatable manner;

spring means for applying a rotary biasing force to move said lock member means in a rotary direction from said first position to said second position upon actuation of said operating member when said lock member means is caused to disengage from said first lock portion means, and for applying an axial biasing force to move said lock member means in an axial direction transverse to said rotary direction into locking relation with said first lock portion means when said lock member means is in alignment with said first lock portion means and into locking relation with said second lock portion means.

2. A cigarette lighter according to claim 1, wherein said lock member means includes operating projection means for engaging with said operating member when said lock member means is locked in said second position, to prevent actuation of said operating member.

3. A cigarette lighter according to claim 2, wherein said operating member includes lock projection means for engaging with said operating projection means when said lock member means is at said second position, to prevent actuation of said operating member, said lock projection means including cut-away means for preventing engagement of said operating projection means with said lock projection means when said lock member means is at said first position.

4. A cigarette lighter according to claim 1, wherein said lock member means includes a main body and leg means depending from said main body, and said spring means includes a coil spring surrounding said leg means to bias said main body in said axial direction and connected with said main body to apply said rotary biasing force.

5. A cigarette lighter according to claim 1, further including a casing having a substantially U-shaped guide hole, with a first leg opening constituting said first lock portion means, a second opposite leg opening constituting said second lock portion means and a connecting opening connecting said first and second leg openings.

* * * * *